US009627797B2

(12) United States Patent
Song et al.

(10) Patent No.: US 9,627,797 B2
(45) Date of Patent: Apr. 18, 2017

(54) EJECTION ASSEMBLY WITH PLUG FEATURE

(71) Applicant: Apple Inc., Cupertino, CA (US)

(72) Inventors: Yuanyuan Song, Cupertino, CA (US); Wei Guang Wu, Cupertino, CA (US); SungChang Lee, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 14/805,035

(22) Filed: Jul. 21, 2015

(65) Prior Publication Data

US 2017/0025785 A1 Jan. 26, 2017

(51) Int. Cl.
*H01R 13/62* (2006.01)
*H01R 13/52* (2006.01)

(52) U.S. Cl.
CPC ..... *H01R 13/5213* (2013.01)

(58) Field of Classification Search
CPC ..... H01R 13/633; H01R 13/62938; H01R 13/637; G06K 13/08; G06F 1/1626; G06F 1/187; G06F 1/184; G06F 1/1632; G11B 33/08
USPC ..... 439/152, 157–160; 361/679.3–679.41, 361/754, 798
See application file for complete search history.

(56) References Cited

U.S. PATENT DOCUMENTS 3,950,627 A 4/1976 Murata et al.
5,041,330 A 8/1991 Heerton et al.
5,179,505 A * 1/1993 Matsuo ..... G06K 13/08 235/495
5,258,592 A 11/1993 Nishikawa et al.
5,373,487 A 12/1994 Crawford et al.
6,166,662 A 12/2000 Chuang
6,292,358 B1 9/2001 Lee et al.
6,389,143 B1 5/2002 Leedom et al.
6,501,036 B2 12/2002 Rochon et al.
6,855,173 B2 2/2005 Ehrnsperger et al.
6,963,039 B1 11/2005 Weng et al.
7,075,781 B2 7/2006 Peng
7,087,850 B1 8/2006 Murzanski
7,230,196 B2 6/2007 Toyama
7,355,137 B2 4/2008 Kawasaki et al.
7,365,281 B2 4/2008 Yamaguchi et al.
7,580,533 B2 8/2009 Schwartz
(Continued)

FOREIGN PATENT DOCUMENTS

CN 102565149 7/2012
CN 104517772 4/2015
(Continued)

OTHER PUBLICATIONS

Author Unknown, "What to Do when Gadgets Get Wet," http://gadgetshow.channel15.com/gadget-show/blog/what-to-do-when-gadgets-get-wet, 2 pages, Aug. 23, 2010.

*Primary Examiner* — Thanh Tam Le
(74) *Attorney, Agent, or Firm* — Brownstein Hyatt Farber Schreck, LLP

(57) ABSTRACT

Disclosed herein is a plug feature for an electronic device. More specifically, the plug feature described herein is used to plug, fill or otherwise seal an aperture associated with a SIM tray of an electronic device. The plug feature may be coupled to an ejection mechanism and may extend at least partially into an aperture defined by the SIM tray and/or an aperture defined by the housing of the electronic device.

20 Claims, 5 Drawing Sheets

(56) References Cited

U.S. PATENT DOCUMENTS 7,748,272 B2 7/2010 Kranz et al.
7,764,936 B2 7/2010 Nakasano et al.
7,865,210 B2 * 1/2011 Wang ..... H04M 1/026 439/153
8,059,490 B2 11/2011 Rapps et al.
8,092,691 B2 1/2012 Youngs et al.
D653,640 S 2/2012 Kwon et al.
8,231,795 B2 7/2012 Martin et al.
8,263,886 B2 9/2012 Lin et al.
8,367,928 B2 2/2013 Hsu et al.
8,371,866 B1 * 2/2013 Su ..... G06K 13/0862 439/159
8,381,575 B2 2/2013 Seo
8,416,542 B2 4/2013 Nakamura
8,446,713 B2 5/2013 Lai
8,462,514 B2 * 6/2013 Myers ..... G06K 13/08 361/754
8,470,252 B2 6/2013 Odueyungbo
8,482,305 B2 7/2013 Johnson
8,500,348 B2 8/2013 Dumont et al.
8,526,175 B2 * 9/2013 Yukawa ..... G06F 3/0423 361/679.33
8,562,095 B2 * 10/2013 Alleyne ..... B41J 2/06 347/14
8,591,240 B2 11/2013 Jenks
8,614,897 B2 * 12/2013 Tang ..... G06K 13/08 361/752
8,624,144 B2 1/2014 Chiang
8,644,011 B2 2/2014 Parkinson
8,683,861 B2 4/2014 Humbert et al.
8,767,381 B2 * 7/2014 Shukla ..... G06F 1/1658 361/679.01
8,770,996 B2 * 7/2014 Hsu ..... H01R 13/635 439/159
8,800,764 B2 8/2014 Wu
8,804,993 B2 8/2014 Shukla et al.
8,826,558 B2 9/2014 Priebe et al.
8,844,158 B2 9/2014 Dehn
8,942,401 B2 1/2015 Murayama
8,960,818 B2 * 2/2015 Myers ..... 312/319.2
8,994,827 B2 3/2015 Mistry et al.
9,013,888 B2 * 4/2015 Trzaskos ..... G06K 13/0806 29/592.1
9,072,991 B2 7/2015 Winters et al.
9,080,961 B2 7/2015 Adachi
9,084,053 B2 7/2015 Parkins
9,084,357 B2 7/2015 Shedletsky et al.
9,099,264 B2 8/2015 Shedletsky et al.
9,105,420 B2 8/2015 Shah et al.
9,129,757 B2 9/2015 Kanbayashi et al.
9,161,434 B2 10/2015 Merz et al.
9,164,539 B2 * 10/2015 Wu ..... G06F 1/1613
9,171,535 B2 10/2015 Abe et al.
9,226,076 B2 12/2015 Lippert et al.
9,240,292 B1 1/2016 Lapetina
9,253,297 B2 2/2016 Abe et al.
2006/0210062 A1 9/2006 DeMichele et al.
2007/0003081 A1 1/2007 Ram et al.
2008/0302641 A1 12/2008 Su
2009/0281251 A1 11/2009 Bae et al.
2012/0067711 A1 3/2012 Yang
2013/0037396 A1 2/2013 Yu
2013/0146491 A1 6/2013 Ghali et al.
2013/0170685 A1 7/2013 Oh et al.
2013/0242481 A1 9/2013 Kim et al.
2014/0029206 A1 * 1/2014 Wittenberg ..... H05K 1/18 361/728
2014/0218877 A1 8/2014 Wei et al.
2014/0253150 A1 9/2014 Menzel et al.
2015/0003213 A1 1/2015 Suwald
2016/0052017 A1 2/2016 Weber et al.
2016/0239047 A1 8/2016 Weber
2016/0241945 A1 8/2016 Zadesky et al.

FOREIGN PATENT DOCUMENTS

CN 105049966 11/2015
CN 204906680 12/2015
CN 105323674 2/2016
EP 0799747 10/1997
EP 2326106 5/2011
EP 2640042 9/2013
JP S5620399 2/1981
JP 200353872 2/2003
JP 200483811 3/2004
JP 2004235724 8/2004
JP 2004244607 9/2004
JP 2011187298 9/2011
JP 2012253426 12/2012
WO WO2012/117476 9/2012
WO WO2015/167848 11/2015

* cited by examiner

EJECTION ASSEMBLY WITH PLUG FEATURE

FIELD

The described embodiments relate generally to a plug feature for an ejection assembly of an electronic device. More particularly, the disclosed embodiments relate to a plug feature for an ejection assembly for a subscriber identification module (SIM) tray.

BACKGROUND

Many electronic devices include a SIM tray that holds a SIM card. In order to open the SIM tray and access the SIM card, a tool is typically inserted through an aperture in the SIM tray and into a corresponding aperture within the housing of the electronic device. When force is applied to the tool, the SIM tray opens, revealing the SIM card.

However, the aperture within the SIM tray and the corresponding aperture within the housing may permit liquid or other contaminants to enter the housing of the electronic device. The liquid and contaminants can damage the inner components of the electronic device and cause the electronic device to fail.

SUMMARY

Disclosed is an electronic device having an ejection assembly with a plug feature. The electronic device includes a SIM tray that defines an outer aperture. The electronic device also includes a housing that defines an inner aperture. The inner aperture is aligned with the outer aperture. An ejection mechanism is positioned within the housing. A plug feature is coupled to the ejection mechanism. The plug feature extends at least partially into the inner aperture. The ejection mechanism causes the SIM tray to eject from the housing in response to an actuation force.

Also disclosed is an electronic device. The electronic device includes a housing and a SIM tray. The SIM tray is at least partially received in the housing and a tool aperture is defined by the SIM tray. The electronic device also includes an ejection mechanism positioned within the housing. The ejection mechanism ejects the SIM tray from the housing in response to an actuation force. A plug feature is coupled to the ejection mechanism and prevents contaminants from entering the housing through the tool aperture.

A housing for an electronic device is also described. The housing includes a SIM tray that defines an outer aperture. An inner aperture is formed in the housing and is aligned with the outer aperture. An ejection mechanism is contained within the housing. The ejection mechanism is coupled to a plug feature. The plug feature is aligned with the inner aperture and the outer aperture and seals at least the inner aperture.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1A:
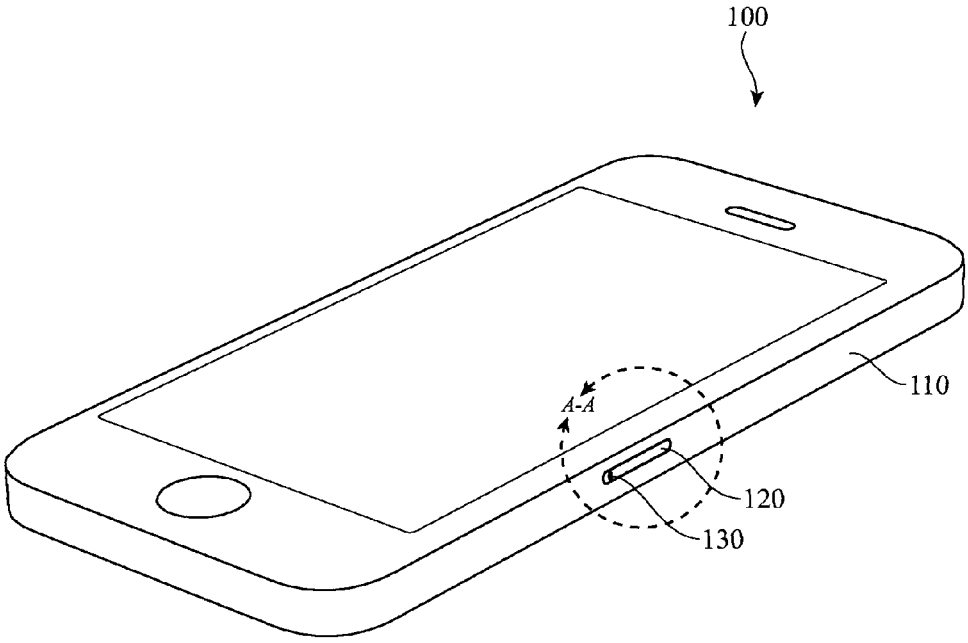
FIG. 1A shows an example electronic device having an ejection mechanism with a plug feature according to one or more embodiments of the present disclosure.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure is directed to an ejection assembly of an electronic device. More specifically, the embodiments described herein are directed to an ejection assembly for a subscriber identity module (SIM) tray of an electronic device. The ejection assembly includes an ejection mechanism and a plug feature. The plug feature is coupled to the ejection mechanism and seals or otherwise fills an aperture in the housing of the electronic device. The plug feature may also seal an associated aperture in the SIM tray.

For example, the housing of the electronic device may include an inner aperture. The SIM tray may include an outer aperture that is aligned with the inner aperture. An ejection tool may be inserted through the inner aperture and the outer aperture and contact the ejection mechanism within the housing of the electronic device. When an actuation force is applied to the ejection mechanism via the ejection tool, the ejection mechanism pivots about an axis. Actuation of the ejection mechanism causes the SIM tray to eject from or otherwise slide out of the housing.

As the inner aperture and the outer aperture are essentially openings in the housing of the electronic device, water, moisture, and/or other contaminants may enter the housing of the electronic device though these apertures. The water or other contaminants may damage the internal components of the electronic device.

To prevent these contaminants from entering the housing through these apertures, a plug feature is disclosed. The plug feature is used to seal the inner aperture and, in some cases, the outer aperture. In some instances, the plug feature is coupled to the ejection mechanism. In other implementations, the plug feature is aligned with or surrounds the inner aperture. The plug feature may extend into the inner aperture to seal the housing. The plug feature may also extend into the outer aperture.

As the plug feature is contained within the inner aperture, when the ejection tool is inserted through the outer aperture and the inner aperture, the ejection tool contacts the plug feature. When an actuation force is applied to the ejection mechanism via the plug feature, the actuation force causes both the plug feature and the ejection mechanism to actuate and thereby eject the SIM tray.

These and other embodiments are discussed below with reference to FIGS. 1A-5. However, those skilled in the art will readily appreciate that the detailed description given herein with respect to these Figures is for explanatory purposes only and should not be construed as limiting.

FIG. 1A shows an example electronic device 100 having an ejection assembly with a plug feature according to one or more embodiments of the present disclosure. As shown in FIG. 1A, the electronic device 100 is a mobile telephone. However, the plug feature described herein may be used in a variety of other electronic devices including, but not limited to, tablet computers, wearable electronic devices, laptop computing devices, global positioning systems, and so on.

More specifically, the plug feature may be used with an electronic device 100 having a SIM tray. In other implementations, the plug feature may be used in any device, electronic or otherwise, having a memory card slot, an expansion card slot, a compact disc tray, a locking data port, a stylus eject button or mechanism, a band release mechanism (e.g., for a wearable electronic device), a housing release mechanism, a battery door release mechanism, a reset button aperture and the like.

Put another way, the plug feature described herein may be used in any device, including mechanical devices, medical devices and so on, that has an aperture that extends through a housing of the device and has an actuation mechanism that is aligned with the aperture. When coupled to the actuation mechanism, the plug feature may be inserted into the aperture to seal the aperture against contaminants.

The plug feature described herein may be reusable. That is, the plug feature may be inserted into and removed from the inner aperture and the outer aperture any number of times.

In other implementations, the plug feature may be used as a security or anti-tampering feature. For example, the plug feature may be a destructible plug feature that indicates when a port or aperture in the electronic device has been accessed. That is, the plug feature may seal an aperture in a housing of an electronic device. However, if a tool is inserted into the aperture and breaks or otherwise disturbs the plug feature, a user of the electronic device may know that the aperture has been accessed.

Referring back to FIG. 1A, the electronic device 100 includes a housing 110. The housing 110 surrounds the periphery of the electronic device 100 and encloses various components of the electronic device 100. A SIM tray 120 may be at least partially received or contained within the housing 110. The SIM tray 120 includes a SIM card that stores data about the electronic device and/or data about the user of the electronic device 100.

Figure 1B:
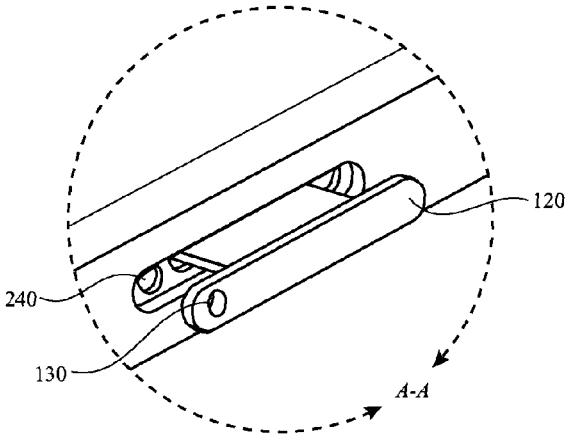
FIG. 1B shows a close-up view of a SIM tray of the electronic device of FIG. 1A according to one or more embodiments of the present disclosure.

In order to eject the SIM tray 120, an ejection tool is inserted into a tool aperture such as outer aperture 130. The outer aperture 130 extends through a surface of the SIM tray 120. FIG. 1B illustrates region A-A of FIG. 1A with the SIM tray 120 partially ejected. As shown in this figure, the outer aperture 130 is aligned with a tool aperture within the housing 110. More specifically, the electronic device 100 includes an inner aperture 240 that extends through the housing 110. As will be described below, the inner aperture 240 and the outer aperture 130 are aligned with an ejection mechanism. Thus, when an ejection tool is inserted through the outer aperture 130 and the inner aperture 240, the ejection tool contacts the ejection mechanism. When an actuation force is applied to the ejection tool, the actuation force causes the ejection mechanism to move or rotate. Movement of the ejection mechanism causes the SIM tray 120 to eject from the housing 110.

As will be described below, the plug feature (not shown) seals the inner aperture 240 and prevents moisture, water or other contaminants from entering the housing 110. In some implementations, the plug feature may extend entirely through the inner aperture 240 and partially or entirely through the outer aperture 130. Thus, a surface of the plug feature may be flush or substantially flush with respect to the housing 110 and/or the SIM tray 120.

FIGS. 2A-5 illustrate top-down views of various ejection assemblies for use with an electronic device, such as electronic device 100. For clarity purposes, the SIM tray, such as, for example, SIM tray 120, has been omitted from these figures for clarity. Accordingly and as shown in these figures, the ejection assemblies may be contained within the housing of the electronic device and interact with a SIM tray in order to eject the SIM tray from the electronic device.

Figure 2A:
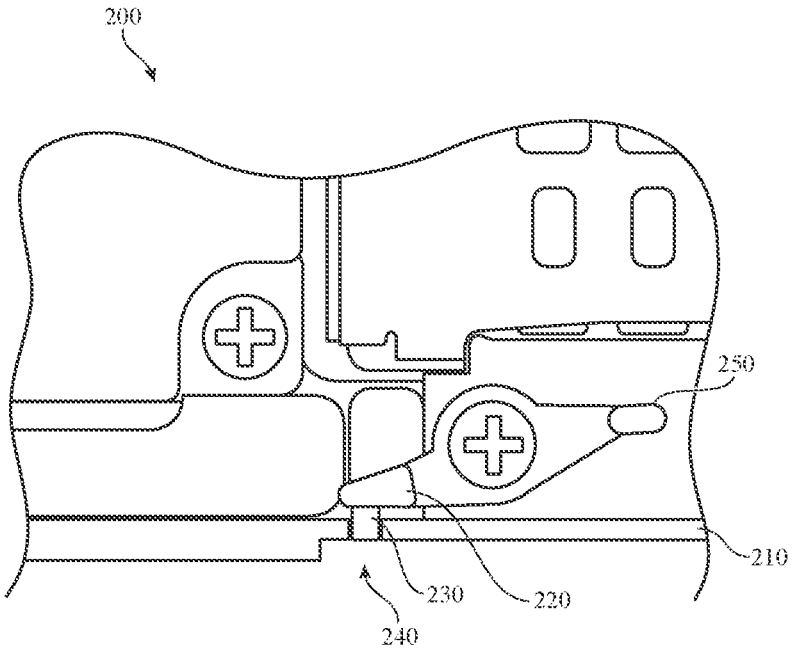
FIG. 2A shows a top-down view of an ejection assembly having a plug feature according to one or more embodiments of the present disclosure.

FIG. 2A shows a top-down view of an ejection assembly 200 having a plug feature 230 according to one or more embodiments of the present disclosure. The ejection assembly 200 may be contained within an electronic device such as the electronic device 100 shown and described with respect to FIG. 1A.

More specifically, the ejection assembly 200 may be contained within a housing 210 of the electronic device. The ejection assembly 200 includes an ejection mechanism 220 and a plug feature 230. As will be described below, the ejection mechanism 220 rotates about an axis in response to an actuation force. As the ejection mechanism 220 rotates, a distal end 250 of the ejection mechanism 220 contacts a portion of the SIM tray and ejects the SIM tray from the housing 210. The SIM tray may sit atop the distal end 250 of the ejection mechanism 220, and so is not visible in the cross-section view of FIGS. 2A-2B.

In some implementations, the plug feature 230 is coupled to the ejection mechanism 220 using an epoxy or glue. In another implementation, the ejection mechanism 220 and the plug feature 230 are formed as a single unitary structure. That is, the plug feature 230 is integrally formed with the ejection mechanism 220. In still yet another implementation, a portion of the plug feature 230 may fit over or otherwise be coupled to a portion of the ejection mechanism 220. The plug feature 230 may also fit within and extend from an arm or other portion of the ejection mechanism 220. For example, the ejection mechanism 220 may define a cavity or recess from which the plug feature 230 extends.

The plug feature 230, or one or more surfaces of the plug feature 230, may have a hydrophobic coating. For example, the surface of the plug feature 230 that extends into the inner aperture 240 may be coated with a hydrophobic coating to help keep moisture or water from entering the housing 210.

The plug feature 230 may also have a coating on one or more surfaces that facilitates the plug feature 230 being removed from and inserted into the inner aperture 240. For example, and not by way of limitation, the coating on the plug feature 230 may be a polytetrafluoroethylene coating or other such coating that reduces friction between the plug feature 230 and the inner aperture 240.

As shown in FIG. 2A, the plug feature 230 and the ejection mechanism 220 are aligned with the inner aperture 240. The inner aperture 240 may extend entirely through the housing 210. Although not shown in FIG. 2A, the inner aperture 240 may be aligned with an outer aperture. For example, the inner aperture 240 is aligned with an aperture in a SIM tray such as the outer aperture 130 described above with respect to FIG. 1A.

Figure 6:
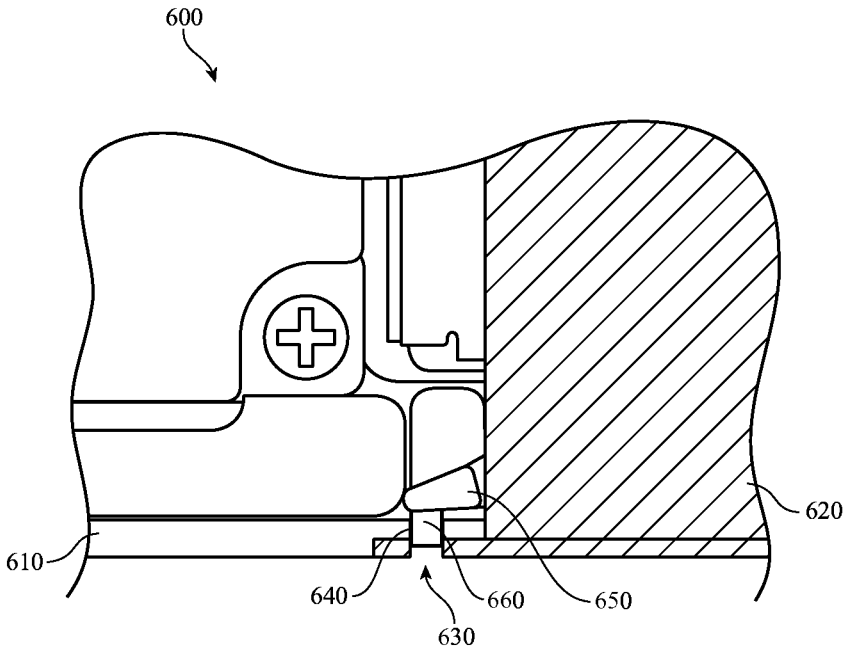
FIG. 6 shows a top-down view of a SIM tray inserted into an electronic device and an associated ejection assembly having a plug feature according to one or more embodiments of the present disclosure.

The plug feature 230 may extend partially though the inner aperture 240 when the ejection mechanism 220 is in its nominal state such as shown in FIG. 2A (e.g., the SIM tray is present and retained within the electronic device). In another implementation, the plug feature 230 may extend entirely though the inner aperture 240 such that a surface of the plug feature 230 is flush or substantially flush with the housing 210. In yet another implementation, the plug feature 230 may extend entirely though the inner aperture 240 and partially or entirely though an outer aperture such as shown in FIG. 6.

The plug feature 230 may be made of rubber, plastic or other synthetic polymer. The plug feature 230 may be compressible, although this is not necessary, and may have a diameter that is larger than inner aperture 240. Even though the diameter of the plug feature 230 may be larger than the diameter of the inner aperture 240, the plug feature 230 may be compressed to fit within the inner aperture 240. For example, as the ejection mechanism 220 returns to its nominal state, the ejection mechanism 220 may force or otherwise insert the plug feature 230 back into the inner aperture 240.

In some implementations, the ejection mechanism 220 returns to its nominal state through operation of a biased spring mechanism. In another implementation, the ejection mechanism returns to its nominal state when the SIM tray is inserted back into the housing 210.

Figure 2B:
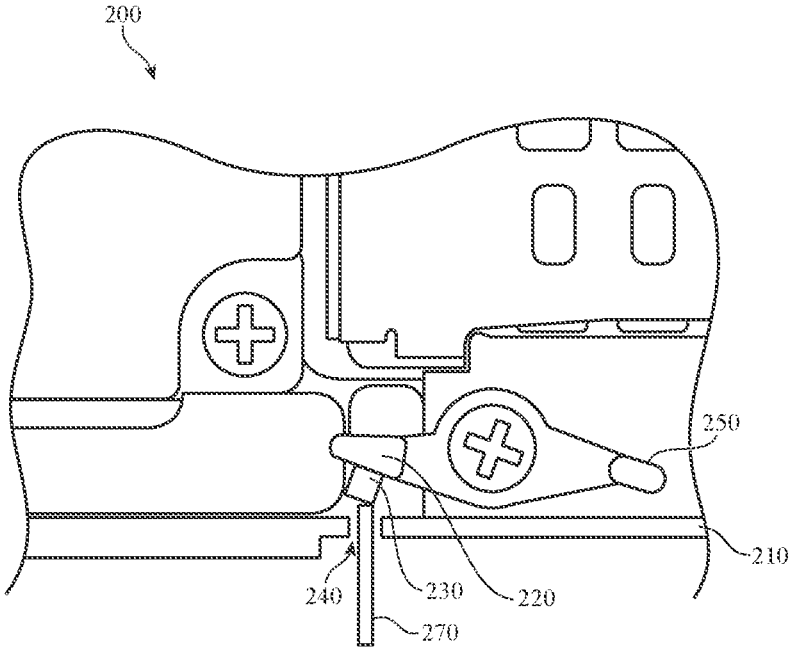
FIG. 2B shows a top-down view of the ejection assembly of FIG. 2A being actuated by an ejection tool according to one or more embodiments of the present disclosure.

The compressible nature of the plug feature 230 may also assist in removing the plug feature 230 from the inner aperture 240. For example and as shown in FIG. 2B, an ejection tool 270 may be inserted into the inner aperture 240. More specifically, the ejection tool 270 may be inserted through an outer aperture (e.g., outer aperture 130 (FIG. 1A)) and through the inner aperture 240. Once inserted, the ejection tool 270 may contact the plug feature 230. When an actuation force is applied to the ejection tool 270, the ejection tool 270 may compress the plug feature 230 and actuate the ejection mechanism 220. In response to the actuation force, the ejection mechanism 220 moves or pivots about an axis point 260. A distal end 250 of the ejection mechanism 220 contacts a portion of the SIM tray and pushes the SIM tray out of the housing 210.

Although movement of the ejection mechanism 220 is described as pivoting, the ejection mechanism 220 may move in various manners in response to an applied force. For example, the ejection mechanism 220 may move up and down in response to an applied force, side to side in response to an applied force, back and forth in response to applied force and so on.

Additional structures may assist in ejecting a SIM tray from an electronic device, in addition to the action of the distal end 250 of the ejection mechanism 220. For example, actuating the ejection mechanism 220 may not only cause the ejection mechanism 220 to pivot about its axis point 260 but may also disengage one or more teeth or detents from the SIM tray. For example, rotating the ejection mechanism 220 may move detents away from grooves or other mating features in the SIM tray so that the detents no longer lock the SIM tray in place. Thus, actuation of the ejection mechanism 220 may also dislodge securing features from the SIM tray as well as impart motion to the SIM tray. The exact mechanical structure though which the motion of the ejection mechanism 220 causes the SIM tray to eject from the housing 210 may vary from device to device or between embodiments, and so only sample structures and operations are described herein. It should be appreciated that the seal and plug feature 230 creating the seal may be used with any suitable SIM tray ejection structure.

During actuation of the ejection mechanism 220, the plug feature 230 may be partially or entirely removed from the inner aperture 240. Once the actuation force is removed from the ejection mechanism 220, the ejection mechanism 220 returns to its nominal state in which the plug feature 230 is positioned or otherwise contained within the inner aperture 240.

Figure 3:
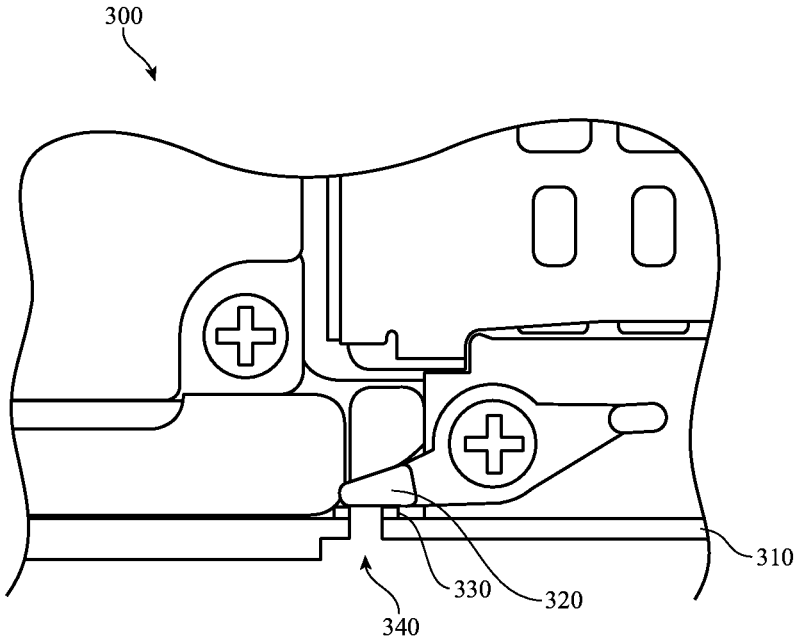
FIG. 3 shows a top-down view of an ejection assembly and an associated sealing member according to one or more embodiments of the present disclosure.

FIG. 3 shows a top-down view of an ejection assembly 300 and an associated plug feature 330 according to one or more embodiments of the present disclosure. In the embodiment shown in FIG. 3, the plug feature 330 is a sealing member. The sealing member is used to seal an inner aperture 340 of the housing 310. More specifically, the sealing member may surround the inner aperture 340 or otherwise be aligned with the inner aperture 340. The sealing member, or portions of the sealing member, may also extend into the inner aperture 340. Non-limiting examples of a sealing member include, but are not limited to, a gasket, an O-ring and the like.

An ejection mechanism 320 may be positioned adjacent to or otherwise be aligned with the sealing member. The sealing member may have a surface profile that mates with a surface profile of the ejection mechanism 320 and vice versa. For example, a surface of the sealing member may include a cutout or other such feature that mates with a corresponding feature on an arm or other portion of the ejection mechanism 320.

In some implementations, the sealing member is coupled to the ejection mechanism 320. Thus, as the ejection mechanism pivots about an axis and moves from a first position to a second position, the sealing member also moves from a first position to a second position.

In another implementation, the sealing member is coupled to the housing 310. As the ejection mechanism 320 is actuated, the sealing member remains on the housing 310.

The sealing member may be made of silicon or other expandable and/or compressible material. In such implementations, the sealing member may be coupled to both the housing 310 and the ejection mechanism 320. As the ejection mechanism 320 is actuated, the sealing member expands. When the ejection mechanism 320 moves back to its nominal state, the sealing member contracts.

Figure 4:
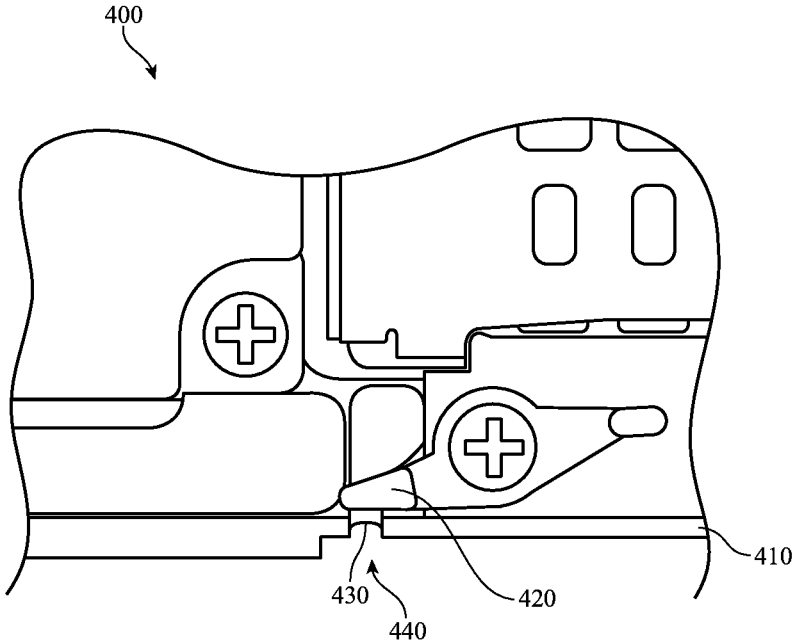
FIG. 4 shows a top-down view of an ejection assembly having a plug feature according to a first alternative embodiment of the present disclosure.

FIG. 4 shows a top-down view of an ejection assembly 400 having a plug feature 430 according to a first alternative embodiment of the present disclosure. The ejection assembly 400 may function in a similar manner as the ejection assembly 200 described above with respect to FIG. 2A. For example, a plug feature 430 may be coupled to an ejection mechanism 420. As the ejection mechanism 420 is actuated, the plug feature 430 moves from a first position to a second position.

The plug feature 430 of this particular embodiment has a concave outer surface (e.g., a surface that is exposed to the opening of the inner aperture 440 of the housing 410 and/or an outer aperture). Although a concave outer surface is shown, the outer surface of the plug feature 430 may be in a variety of different configurations and shapes. For example, the outer surface of the plug feature 430 may be convex.

Figure 5:
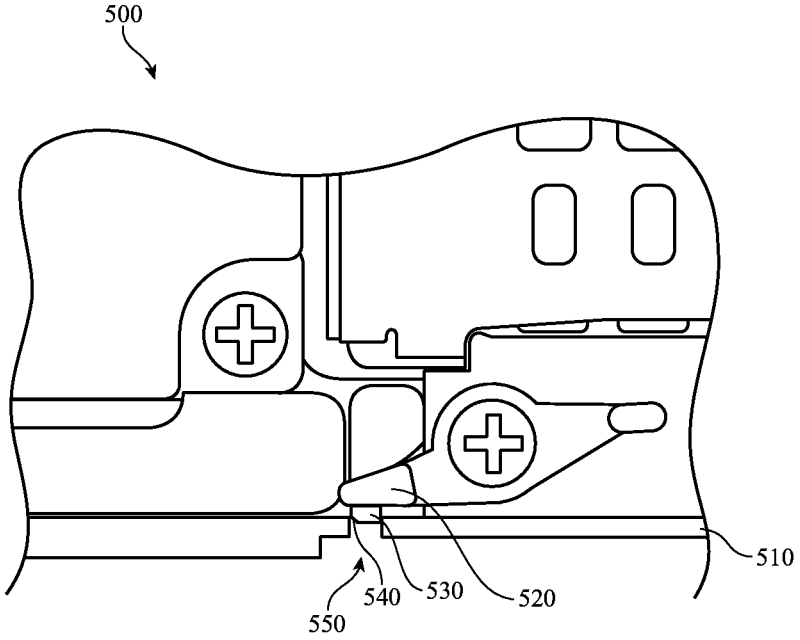
FIG. 5 shows a top-down view of an ejection assembly having a plug feature according to a second alternative embodiment of the present disclosure.

FIG. 5 shows a top-down view of an ejection assembly 500 having a plug feature 530 according to a second alternative embodiment of the present disclosure. The ejection assembly 500 may function in a similar manner to the ejection assembly 200 described above. That is, the plug feature 530 may be coupled to an ejection mechanism 520. The plug feature 530 may also extend into an inner aperture 550 defined by the housing 510 of an electronic device.

In the embodiment shown in FIG. 5, the plug feature 530 includes a chamfered edge 540. The chamfered edge 540 facilitates the removal and insertion of the plug feature 530 into the inner aperture 550 of the housing 510. For example, the chamfered edge 540 may permit a sidewall of the plug feature 530 to pass by or minimally contact a sidewall of the housing 510 as the ejection mechanism 520 pivots or rotates about an axis in response to an actuation force. When the actuation force is removed, the chamfered edge 540 may also enable the plug feature 530 to be easily inserted back into the inner aperture 550.

FIG. 6 shows a top-down view of a SIM tray 620 inserted into an electronic device and an associated ejection assembly 600 having a plug feature 660 according to one or more embodiments of the present disclosure. The ejection assembly 600 may function in a similar manner to the ejection assembly 200 described above. That is, the plug feature 660 may be coupled to an ejection mechanism 650. The plug feature 660 may extend into an inner aperture 640 defined by the housing 610 of an electronic device. The plug feature may also extend into an outer aperture 630 defined by the SIM tray 620.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. An electronic device comprising:
- a SIM tray defining an outer aperture;
- a housing defining an inner aperture aligned with the outer aperture;
- an ejection mechanism; and
- a plug feature fixedly coupled to the ejection mechanism, the plug feature extending at least partially into the inner aperture.

2. The electronic device of claim 1, wherein the plug feature comprises a hydrophobic coating.

3. The electronic device of claim 1, wherein the plug feature is compressible.

4. The electronic device of claim 1, wherein the plug feature comprises a chamfered edge.

5. The electronic device of claim 1, wherein the plug feature comprises a polytetrafluoroethylene coating.

6. The electronic device of claim 1, wherein the plug feature seals the inner aperture.

7. The electronic device of claim 1, wherein the plug feature extends at least partially into the outer aperture.

8. An electronic device comprising:
- a housing;
- a SIM tray at least partially received in the housing;
- a tool aperture defined by the SIM tray;
- an ejection mechanism positioned within the housing of the electronic device to eject the SIM tray from the housing in response to an actuation force; and
- a plug feature fixedly coupled to the ejection mechanism and preventing contaminants from entering the housing through the tool aperture.

9. The electronic device of claim 8, wherein the plug feature receives the actuation force.

10. The electronic device of claim 8, wherein an outer surface of the plug feature is substantially flush with the housing.

11. The electronic device of claim 8, wherein:
- the plug feature extends at least partially into the tool aperture; and
- the plug feature is removed from the tool aperture in response to the actuation force.

12. The electronic device of claim 11, wherein the plug feature is received in the tool aperture when the actuation force is no longer applied.

13. The electronic device of claim 8, wherein the plug feature comprises a concave outer surface.

14. The electronic device of claim 8, wherein the plug feature comprises a synthetic polymer.

15. A housing for an electronic device, the housing comprising:
- a SIM tray defining an outer aperture;
- an inner aperture formed in the housing and aligned with the outer aperture; and
- an ejection mechanism fixedly coupled to a plug feature, the plug feature aligned with the inner aperture and the outer aperture to seal the inner aperture.

16. The housing of claim 15, wherein the plug feature seals the outer aperture.

17. The housing of claim 15, wherein the plug feature comprises a hydrophobic coating on an outer surface.

18. The housing of claim 15, wherein the plug feature comprises a chamfered edge to facilitate removal of the plug feature from the inner aperture.

19. The housing of claim 15, wherein the plug feature is compressible.

20. The housing of claim 15, wherein the plug feature is receives a force applied by an ejection tool.

* * * * *